US005694749A

United States Patent [19]

Oseland

[11] Patent Number: 5,694,749

[45] Date of Patent: Dec. 9, 1997

[54] STRAPPING TOOL

[75] Inventor: Peter Oseland, Bridgend, United Kingdom

[73] Assignee: ITW Limited, United Kingdom

[21] Appl. No.: 657,226

[22] Filed: Jun. 3, 1996

[30] Foreign Application Priority Data

Jun. 1, 1995 [GB] United Kingdom ..... 9511049

[51] Int. Cl.[6] ..... B65B 67/08

[52] U.S. Cl. ..... 53/592; 53/582

[58] Field of Search ..... 53/582, 592, 375.9; 100/33 R, 33 PB; 156/495, 579, 580

[56] References Cited

U.S. PATENT DOCUMENTS 3,442,733 5/1969 Vilcins ..... 53/592 X 4,305,774 12/1981 Wedeking et al. ..... 53/592 X

FOREIGN PATENT DOCUMENTS 1423688 2/1976 United Kingdom ..... 53/582

*Primary Examiner*—Linda Johnson

*Attorney, Agent, or Firm*—Schwartz & Weinrieb

[57] ABSTRACT

A hand-held tension-weld strapping tool for sequentially tensioning and welding together overlapping portions of strapping comprises a handle, a motor control arm arranged to actuate a motor, a weld actuating arm and a mechanical interlock for holding the motor control arm in an actuated position during a welding cycle. In the preferred embodiment, the mechanical interlock is a cranked extension portion of the motor control arm which, in use, is trapped between the handle and the weld actuating arm when the weld actuating arm is moved to an operative position for actuating a welding cycle.

20 Claims, 2 Drawing Sheets

STRAPPING TOOL

FIELD OF THE INVENTION

The present invention relates to strapping tools, and more particularly to a modification to a hand-held tension-weld strapping tool.

BACKGROUND OF THE INVENTION

Tension-weld strapping tools are typically used to apply a length of polymeric strapping around a package to form a sealed tensioned loop which securely binds the package for shipping, storage and merchandising.

In manually operated tension-weld strapping tools, a length of strapping is first looped around a package and subsequently an operator introduces overlapping ends of the strapping into a strap feeding mechanism of the tool. Tension is then applied to the strap by a feed wheel mechanism driven by a pneumatic motor. The pneumatic motor is actuated by the operator gripping a motor control arm. Finally, the strap is sealed or fixedly secured by friction welding overlapping portions of the strapping and cutting away any excess strapping.

The friction welding cycle is initiated by moving a weld actuating arm into an operative position. The operator must maintain a grip on the motor control arm throughout the welding cycle to ensure the pneumatic motor remains switched on. Accordingly, the formation of a reliable seal or fastening together of the strapping ends is dependent upon the operator maintaining a grip on the motor control arm during the entire tension-weld cycle.

Fully and semi-automatic strapping tools do exist but these require complex and relatively expensive electronic control components.

SUMMARY OF THE INVENTION

According to the present invention, there is disclosed a hand-held tension-weld strapping tool for sequentially tensioning and welding together overlapping portions of strapping, the strapping tool comprising a handle, a motor control arm arranged to actuate a motor, a weld actuating arm, and a mechanical interlock for holding the motor control arm in an actuated position during a welding cycle.

In the present invention, a mechanical interlock is provided which holds the motor control arm in an actuated position during the welding cycle of the tool. Accordingly, the operator is not required to continue to hold the motor control arm during the welding cycle and is free to carry out other tasks. Furthermore, the reliability of the seal or fixation of the strapping ends is no longer dependent on the operator.

Preferably, the mechanical interlock acts between the motor control arm and the weld actuating arm.

Preferably, the mechanical interlock comprises a cranked extension portion of the motor control arm which, in use, is trapped between the handle and the weld actuating arm when the weld actuating arm is moved to an operative position.

BRIEF DESCRIPTION OF THE DRAWINGS

An example of the present invention will be described in detail with reference to the accompanying drawings, in which like reference characters designate like or corresponding parts throughout the several views, and wherein.

DETAILED DESCRIPTION OF THE PREFERRED EMBODIMENT

Figure 1:
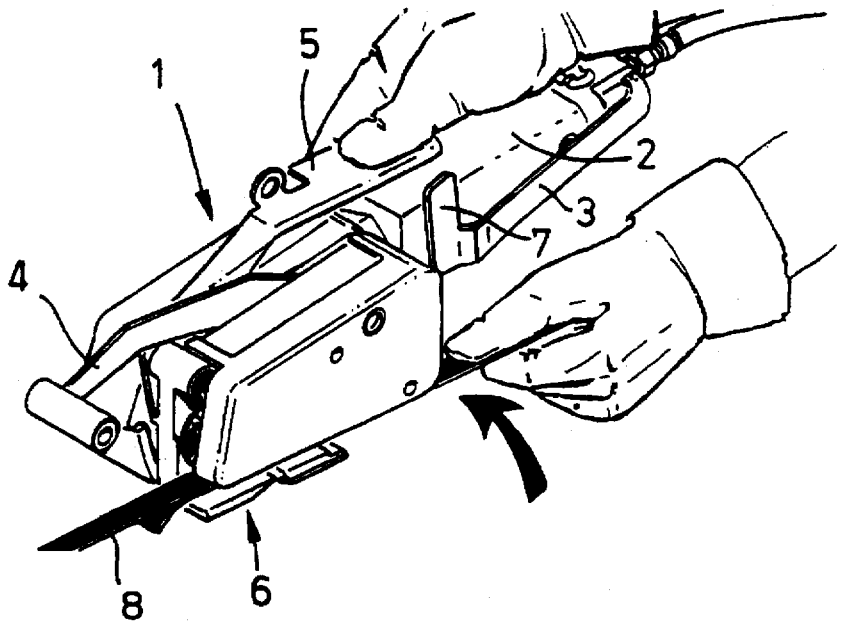
FIG. 1 is a perspective view which shows a length of strapping being introduced into one example of a hand-held tension-weld strapping tool in accordance with the present invention.

A hand-held tension-weld strapping tool 1 shown in FIGS. 1 to 4 comprises a handle 2, a motor control arm 3 arranged to actuate a pneumatic motor housed in the handle 2, a weld actuating arm 4 and an operating lever 5. The tension-weld tool 1 also comprises a feed wheel and welding mechanism 6. As shown in the Figures, the motor control arm 3 includes a cranked extension portion 7, the function of which is described in detail below.

Figure 2:
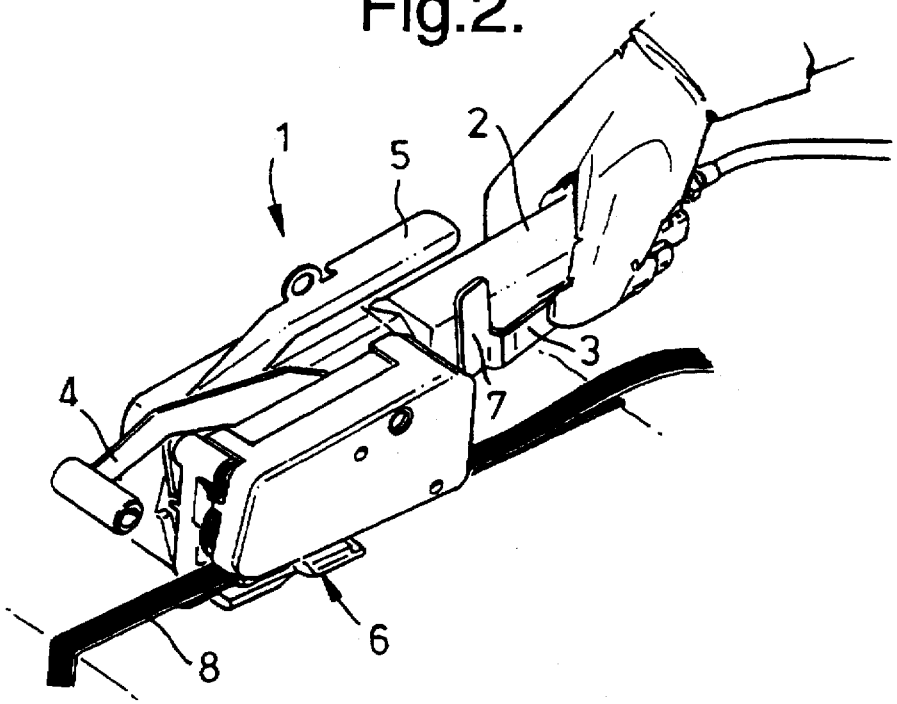
FIG. 2 is a perspective view which shows the tension-weld tool of FIG. 1 applying tension to the strapping; and, FIGS. 3 and 4 are perspective views which show the tension-weld tool friction welding overlapping portions of the strapping to form a seal.
Figure 3:
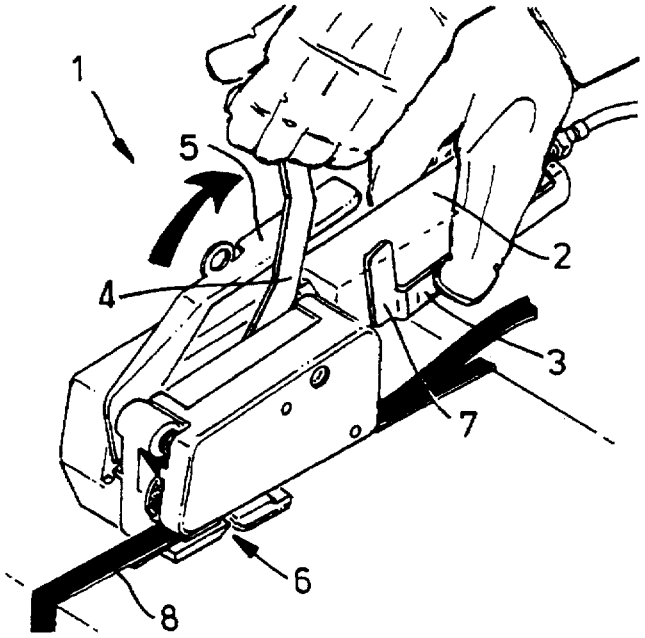
Figure 4:
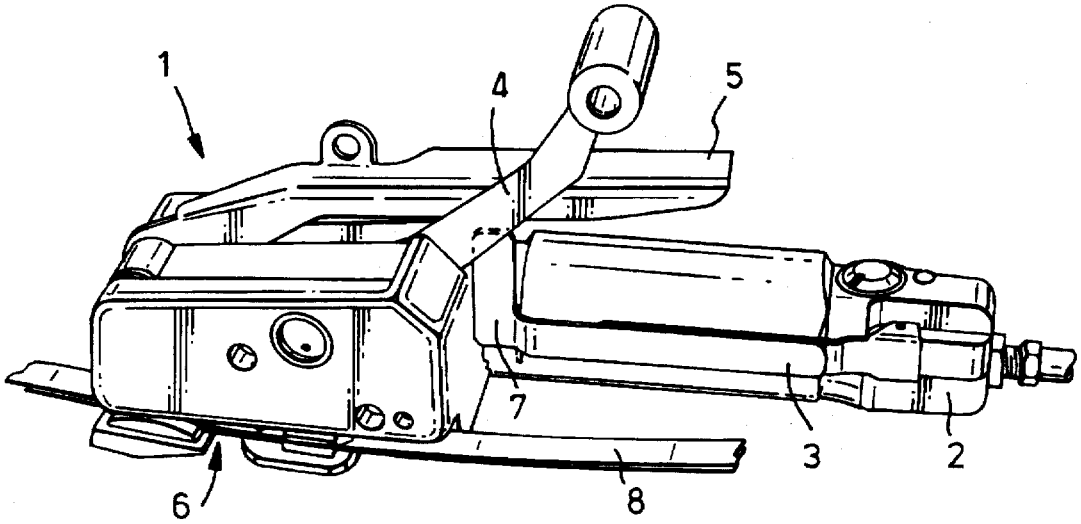

As shown in FIG. 1, an operator loops a length of polymeric strapping 8 around a package. Overlapping portions of the strapping 8 are then inserted into the feed wheel and welding mechanism 6 of the tension-weld tool 1 by depressing the operating lever 5. Next, as shown in FIG. 2, tension is applied to the strap 8 by the operator gripping the motor control arm 3 to actuate the pneumatic motor. Initial actuation of the pneumatic motor drives the feed wheel mechanism 6 until a pre-determined strap tension is achieved, whereupon the pneumatic motor stalls leaving the strap held in tension.

Once the pneumatic motor has stalled, the motor control arm 3 is maintained in the actuated position while the weld actuation arm 4 is pulled back to initiate the friction welding cycle. Once in the position shown in FIG. 4, the weld actuating arm 4 traps the cranked extension portion 7 of the motor control arm 3 in position, thus maintaining the pneumatic motor in an ON state while the welding mechanism 6 friction-welds the overlapping portions of strapping 8 to form a reliable seal or fixation of the overlapped ends of the strapping.

The cranked extension portion 7 of the motor control arm 3 acts as a mechanical interlock so that the operator does not have to maintain a grip on the motor control arm 3 and handle 2 during the welding cycle. Accordingly, a reliable seal fixed fastening of the strapping ends is guaranteed and the operator is free to leave the tool to finish the welding cycle and allow the seal or fastened strapping ends to cool while he carries out other tasks. A further advantage is that existing manually operated tools supplied with a conventional motor control arm may be retro-fitted with a modified motor control arm 3 in accordance with the present invention at very little cost.

The tension-weld strapping tool of the present invention gives a more robust, reliable and cheaper alternative to existing fully or semi-automatic strapping tools. Obviously, many modification and variations of the present invention are possible in light of the above teachings. It is therefore to be understood that within the scope of the appended claims, the present invention may be practised otherwise than as specifically described herein.

I claim:

1. A hand-held tension-weld strapping tool for sequentially tensioning and welding together overlapping portions of strapping, comprising:

a handle defining a longitudinal axis;

a motor drive mechanism for applying a predetermined amount of tension to overlapped portions of strapping;

a motor control arm movable transversely with respect to said longitudinal axis of said handle between a first position at which said motor control arm actuates said motor drive mechanism for applying said predetermined amount of tension to said overlapped portions of said strapping, and a second position at which said motor control arm deactuates said motor drive mechanism;

a welding mechanism for welding together said overlapped portions of said strapping during a welding cycle; and a weld actuating arm movable longitudinally with respect to said handle and said longitudinal axis thereof between a first position at which said weld actuating arm actuates said welding mechanism for welding together said overlapped portions of said strapping during said welding cycle, and for defining with said motor control arm a mechanical interlock for holding said motor control arm at said first position during said welding cycle such that said motor control arm continues to actuate said motor drive mechanism during said welding cycle whereby said predetermined amount of tension continues to be applied to said overlapped portions of said strapping, and a second position at which said weld actuating arm permits said motor control arm to move from said first motor-actuating position to said second motor-deactuating position.

2. A hand held strapping tool according to claim 1, in which said mechanical interlock comprises a cranked extension portion of said motor control arm which, in use, is trapped between said handle and said weld actuating arm when said weld actuating arm is moved to said first position.

3. A hand-held tension-weld strapping tool for sequentially tensioning and welding together overlapping portions of strapping, comprising:

a housing defining a longitudinal axis;

a motor drive mechanism for applying a predetermined amount of tension to overlapped portions of strapping;

a motor control arm movable transversely with respect to said longitudinal axis of said housing between a first position at which said motor control arm actuates said motor drive mechanism to an ON state for applying said predetermined amount of tension to said overlapped portions of strapping, and a second position at which said motor control arm deactuates said motor drive mechanism to an OFF state;

a welding mechanism for welding together said overlapped portions of said strapping during a welding cycle;

a weld actuating arm movable longitudinally with respect to said housing and said longitudinal axis thereof between a first position at which said weld actuating arm actuates said welding mechanism for welding together said said overlapped portions of said strapping during said welding cycle, and a second position at which said weld actuating arm deactuates said welding mechanism; and extension means disposed upon said motor control arm so as to be engaged by said weld actuating arm and thereby form a mechanical interlock with said weld actuating arm, when said weld actuating arm is moved to said first position at which said weld actuating arm actuates said welding mechanism so as to commence said welding cycle, such that said motor control arm is held at said first position during said welding cycle whereby said motor drive mechanism is maintained in said ON state during said welding cycle so that said predetermined amount of tension continues to be applied to said overlapped portions of said strapping during said welding cycle, and to be disengaged from said weld actuating arm, when said weld actuating arm is moved to said second position, such that said motor control arm is permitted to move to said second position whereby said motor drive mechanism is permitted to attain said OFF state.

4. A hand-held tension-weld strapping tool as set forth in claim 3, further comprising:

means for pivotably mounting said motor control arm upon said housing between said first position corresponding to said ON state of said motor drive mechanism and said second position corresponding to said OFF state of said motor drive mechanism; and said extension means comprises an upstanding extension portion of said motor control arm which is trapped between said housing and said weld actuating arm at said first position corresponding to said ON state of said motor drive mechanism when said weld actuating arm is moved to said weld-actuating position.

5. A hand-held tension-weld strapping tool for sequentially tensioning and welding together overlapped portions of strapping, comprising:

a handle defining a longitudinal axis;

a feed mechanism for tensioning overlapped portions of strapping;

motor means for driving said feed mechanism such that a predetermined amount of tension is imparted to said overlapped portions of said strapping;

a motor control arm for controlling the activation of said motor means, wherein said motor control arm is movable transversely with respect to said longitudinal axis of said handle between a first position at which said motor control arm permits said motor means to be disposed in an OFF state, and a second position at which said motor control arm activates said motor means to an ON state such that said predetermined amount of tension is imparted to said overlapped portions of said strapping;

a welding mechanism for welding together said overlapped portions of said strapping when said overlapped portions of said strapping have been subjected to said predetermined amount of tension;

a weld actuating arm for actuating said welding mechanism, wherein said weld actuating arm is movable longitudinally with respect to said handle and said longitudinal axis thereof between a first position at which said weld actuating arm does not activate said welding mechanism to perform a welding cycle upon said overlapped portions of said strapping, and a second position at which said weld actuating arm activates said welding mechanism so as to perform a welding cycle upon said overlapped portions of said strapping; and interlock means defined between said weld actuating arm and said motor control arm for maintaining said motor control arm at said second position so as to maintain said motor means in said ON state when said weld actuating arm is disposed at said second position and said welding mechanism is performing a welding cycle such that said predetermined amount of tension is imparted to said overlapped portions of said strapping during said welding cycle, and for permitting said motor control arm to move to said first position when said weld actuating arm is disposed at said first position such that said motor means is permitted to attain said OFF state.

6. A hand-held tension-weld strapping tool as set forth in claim 5, wherein:

said interlock means is mounted upon said motor control arm and is interposed between said handle and said weld actuating arm when said weld actuating arm is disposed at said second position.

7. A hand-held tension-weld strapping tool as set forth in claim 6, wherein:

said interlock means comprises an upstanding projection of said motor control arm.

8. A hand-held tension-weld strapping tool as set forth in claim 5, further comprising:

means for pivotally mounting said motor control arm upon said handle between said first position at which an end portion of said motor control arm for activating said motor means is disposed remote from said handle, and said second position at which said end portion of said motor control arm for activating said motor means is disposed adjacent to said handle.

9. A hand-held tension-weld strapping tool as set forth in claim 7, further comprising:

means for pivotally mounting said weld actuating arm upon said tool between said first position at which said weld actuating arm is disposed remote from said upstanding projection of said motor control arm, and said second position at which said weld actuating arm is disposed adjacent to said upstanding projection of said motor control arm such that said upstanding projection of said motor control arm is trapped between said handle and said weld actuating arm.

10. A hand-held tension-weld strapping tool as set forth in claim 5, wherein:

said interlock means comprises an upstanding projection integral with said motor control arm for engagement by said weld actuating arm when said weld actuating arm is disposed at said second position so as to maintain said motor control arm at said second position.

11. A hand-held tension-weld strapping tool as set forth in claim 1, further comprising:

means for pivotably mounting said motor control arm upon said handle between said first position corresponding to an ON state of said motor drive mechanism and a second position corresponding to an OFF state of said motor drive mechanism.

12. A hand-held tension-weld strapping tool as set forth in claim 1, wherein:

said mechanical interlock comprises an upstanding extension portion of said motor control arm which is trapped between said handle and said said weld actuating arm at said first position corresponding to said ON state of said motor drive mechanism when said weld actuating arm is moved to said weld-actuating position.

13. A hand-held tension-weld strapping tool as set forth in claim 1, wherein:

said mechanical interlock means comprises a member mounted upon said motor control arm and is interposed between said handle and said weld actuating arm when said weld actuating arm is disposed at said first actuating position.

14. A hand-held tension-weld strapping tool as set forth in claim 13, wherein:

said member of said mechanical interlock means comprises an upstanding projection of said motor control arm.

15. A hand-held tension-weld strapping tool as set forth in claim 11, wherein:

said motor control arm is pivotably mounted at one end portion thereof upon said handle such that a second end portion of said motor control arm is disposed adjacent to said handle when said motor control arm is disposed at said first position so as to actuate said motor drive mechanism to said ON state, and said second end portion of said motor control arm is disposed remote from said handle when said motor control arm is disposed at said second position so as to deactuate said motor drive mechanism to said OFF state.

16. A hand-held tension-weld strapping tool as set forth in claim 12, further comprising:

means for pivotably mounting said weld actuating arm upon said tool between said second position at which said weld actuating arm is disposed remote from said upstanding extension of said motor control arm, and said first position at which said weld actuating arm is disposed adjacent to said upstanding tension of said motor control arm such that said upstanding extension of said motor control arm is trapped between said handle and said weld actuating arm.

17. A hand-held tension-weld strapping tool as set forth in claim 3, further comprising:

means for pivotably mounting said motor control arm upon said housing between said first position corresponding to said ON state of said motor drive mechanism and a second position corresponding to said OFF state of said motor drive mechanism.

18. A hand-held tension-weld strapping tool as set forth in claim 3, wherein:

said extension means comprises an upstanding projection integral with said motor control arm and which is trapped between said housing and said weld actuating arm at said first position corresponding to said ON state of said motor drive mechanism when said weld actuating arm is moved to said weld-actuating position.

19. A hand-held tension-weld strapping tool as set forth in claim 3, wherein:

said motor control arm is pivotably mounted at one end portion thereof upon said housing such that a second end portion of said motor control arm is disposed adjacent to said housing when said motor control arm is disposed at said first position so as to actuate said motor drive mechanism to said ON state, and said second end portion of said motor control arm is disposed remote from said housing when said motor control arm is disposed at said second position so as to deactuate said motor drive mechanism to said OFF state.

20. A hand-held tension-weld strapping tool as set forth in claim 18, further comprising:

means for pivotably mounting said weld actuating arm upon said housing between said second position at which said weld actuating arm is disposed remote from said upstanding projection of said motor control arm, and said first position at which said weld actuating arm is disposed adjacent to said upstanding projection of said motor control arm such that said upstanding projection of said motor control arm is trapped between said housing and said weld actuating arm.

* * * * *